US006028588A

United States Patent [19]

Yoon

[11] Patent Number: 6,028,588

[45] Date of Patent: Feb. 22, 2000

[54] MULTICOLOR DISPLAY CONTROL METHOD FOR LIQUID CRYSTAL DISPLAY

[75] Inventor: Hee Gyung Yoon, Seoul, Rep. of Korea

[73] Assignee: LG Electronics Inc., Seoul, Rep. of Korea

[21] Appl. No.: 09/054,473

[22] Filed: Apr. 3, 1998

[30] Foreign Application Priority Data

May 9, 1997 [KR] Rep. of Korea ..... 97-17990

[51] Int. Cl.[7] ..... G09G 5/04

[52] U.S. Cl. ..... 345/153; 345/89; 345/147; 345/150; 345/155; 345/431; 345/432

[58] Field of Search ..... 345/89, 147, 150, 345/153, 155, 431, 432

[56] References Cited

U.S. PATENT DOCUMENTS

| | | | |
|---|---|---|---|
| 5,138,303 | 8/1992 | Rupel | 345/155 |
| 5,469,190 | 11/1995 | Masterson | 345/155 |
| 5,734,369 | 3/1998 | Priem et al. | 345/155 |
| 5,748,163 | 5/1998 | Han | 345/88 |
| 5,920,305 | 7/1999 | Yoon | 345/153 |

*Primary Examiner*—Bipin Shalwala
*Assistant Examiner*—Vincent E. Kovalick
*Attorney, Agent, or Firm*—Morgan, Lewis & Bockius LLP

[57] ABSTRACT

A dither circuit for reproducing a plurality of colors includes a latch having input terminals for receiving L input data bits and a clock signal, and having output terminals for outputting L output bits, a bit divider having input terminals for receiving the L output bits and a function selection signal, and having output terminals for outputting high M bits and low L–M bits, a function selector having an input terminal for receiving a low bit number signal and an output terminal for outputting a dither method signal, a frame rate and dither timing generator having a first input terminal for receiving the clock signal, a second input terminal for receiving a horizontal sync signal, a third input terminal for receiving a vertical sync signal and a fourth input terminal for receiving the dither method signal, and having output terminals for outputting dither timing bits, a frame rate dither controller having input terminals for receiving the low L–M bits and the dither timing bits, and an output terminal for outputting a dither data bit, and an adder having input terminals for receiving the dither data bit and the high M bits, and output terminals outputting for M output data bits.

9 Claims, 7 Drawing Sheets

MULTICOLOR DISPLAY CONTROL METHOD FOR LIQUID CRYSTAL DISPLAY

This application claims the benefit of Korean patent application No. 97-17990, filed May 9, 1997, which is hereby incorporated by reference.

BACKGROUND OF THE INVENTION

1. Field of the Invention

The present invention relates to a dither method for converting color display information in a liquid crystal display device, and more particularly, to a circuit in which a greater number of colors is represented using a smaller number of color levels.

2. Discussion of the Related Art

The CRT (Cathode Ray Tube) is the most common display device for reproducing color display information. The CRT uses electron guns to display a red color, a green color and a blue color. The greater the screen size, the thicker the CRT must be, because the CRT device can reproduce an image only if a distance between the electron guns and the screen of the CRT is sufficient. Therefore, the CRT is not a proper device for portable display applications.

In recent years, many flat display device alternatives to the CRT have been developed. Among them, a liquid crystal display (LCD) device has become particularly popular. A conventional LCD includes, as shown in FIG. 1, a controller IC (integrated circuit) 13, a scan line driver IC 11, a signal line driver IC 10, and thin film transistors (or TFTs) 16 arranged in an array. A plurality of scan lines 15 are connected to outputs of the scan line driver IC 11, and a plurality of signal lines 14 are connected to outputs of the signal line driver IC 10. The thin film transistors 16 corresponding to an array of pixels 17 are arrayed at intersections of the scan lines 15 and the signal lines 14. A gate electrode of each TFT 16 is connected to the scan line 15, a source electrode of the TFT 16 is connected to the signal line 14, and a drain electrode of the TFT 16 is connected to a pixel electrode. When a voltage is applied to the gate electrode of the TFT 16, the source electrode of the TFT 16 and the drain electrode of the TFT 16 are electrically connected. When there is no voltage on the gate electrode, the source and the drain electrodes of the TFT 16 are electrically isolated.

A conventional method for reproducing an image on an LCD screen is as follows. Image information is converted into a signal voltage by the controller IC 13, and the signal voltage is held at the signal line driver IC 10. The signal line driver IC 10 applies the signal voltage to the signal line 14 in response to a scan signal. For example, when the scan line driver IC 11 applies the scan voltage to the first scan line 15 based on a predetermined frequency signal, the TFTs 16 connected to the first scan line 15 are turned on. The signal voltages of a first line of the image information also are applied to electrodes of a first line of the pixels 17 of the pixel array. When the scan line driver IC 11 applies the scan voltage to the second scan line 15, the signal line driver IC 10 outputs a second line of the image information, which is applied to a second line of electrodes of the pixels 17 of the pixel array. Similarly, voltages representing other lines of the image information are applied to other lines of the pixels 17 of the pixel array. Thus, the image information is reproduced on the LCD device.

In order to reproduce color image information, the image information is divided into color information including red, green and blue (R, G and B) color elements. The color elements are displayed on one pixel of the LCD screen.

These techniques are well known in the field of manufacturing of color LCDs.

A conventional method for reproducing the color information on a color LCD is as follows. FIG. 2 shows a conventional controller IC of the color LCD device. The conventional controller IC includes a ROM (Read Only Memory) table 21 having color data bits that are sent to the signal lines according to a horizontal sync signal $H_s$ and a vertical sync signal $V_s$; a latch 22 for receiving input image data according to the clock signal Ck and sending an address signal to the ROM table 21; and a Frame Rate Controller (FRC) 20 for outputting a signal for determining a dot position and a frame page of the color data bits from the ROM 21.

The input color data, which includes L bits from a video processing unit such as a VGA card, is sent to the latch 22 on the clock signal Ck. At the latch 22, the input color data is translated to an address bit representing an address of the color data in the ROM 21. The FRC 20 determines the scan line 15, where the dot belongs, according to the horizontal sync signal $H_s$, and determines the frame page of the color data according to the vertical sync signal $V_s$. That is, the input color data is used for the address data of the ROM 21, which outputs output color data. The output color data from the ROM 21 is applied to the signal line driver IC 10. The output color data determines the voltage level for driving the liquid crystal. The color image is reproduced on the LCD based on the driving voltage level of the liquid crystal.

The number of primary colors is determined by a number of bits L in the output color data. If the number of bits L is 3, then the color elements, R, G and B, have 3-bit color level. Therefore, the number of colors of one pixel is $2^9$. That is, 512 colors can be reproduced. Hereafter, "true color" refers to color dots R, G and B having 8-bit color levels, so the number of possible colors on one pixel 17 is $2^{24}$=16,777,216. A true color display can therefore reproduce 16.7 million colors.

In the controller IC 13, the number of bits of the input color data is 8 bits, so the 8-bit input color data is true color. However, the output color data is not 8 bits. Because an 8-bit driver IC is very expensive, a total price of LCD would also be high. Generally, the price of a driver IC for 3-bit data or 6-bit data is \$5 or \$9 respectively, and that of an 8-bit driver IC is between \$25 and \$40. Furthermore, manufacturing the LCD panel is complicated if the output data bus line is 8 bits, as compared to using a data bus line with fewer than 8 bits. Thus, a great deal of research and development is directed towards reproducing true color using less than 8 bits.

Additionally, a conventional controller IC 13 uses a ROM table for reproducing the color information. The ROM is also very expensive. Even though the output color data may be 6 bits, the frames for reproducing true color must have different color levels. Thus, more ROM is needed, and the manufacturing cost of the LCD increases.

SUMMARY OF THE INVENTION

Accordingly, the present invention is directed to a multicolor display control method for liquid crystal display that substantially obviates one or more of the problems due to the limitations and disadvantages of the related art.

An object of the present invention is to provide a method for manufacturing an LCD driving circuit for reproducing true color using fewer bits than input color data bits, and to avoid using ROM for memory color table.

Additional features and advantages of the present invention will be set forth in the description which follows, and will be apparent from the description, or may be learned by practice of the invention. The objectives and other advantages of the invention will be realized and attained by the structure and process particularly pointed out in the written description as well as in the appended claims.

To achieve these and other advantages and according to the purpose of the present invention, as embodied and broadly described, in a first aspect of the present invention there is provided a dither circuit for reproducing a plurality of colors including a latch having input terminals for receiving L input data bits and a clock signal, and having output terminals for outputting L output bits, a bit divider having input terminals for receiving the L output bits and a function selection signal, and having output terminals for outputting high M bits and low L–M bits, a function selector having an input terminal for receiving a low bit number signal and an output terminal for outputting a dither method signal, a frame rate and dither timing generator having a first input terminal for receiving the clock signal, a second input terminal for receiving a horizontal sync signal, a third input terminal for receiving a vertical sync signal and a fourth input terminal for receiving the dither method signal, and having output terminals for outputting dither timing bits, a frame rate dither controller having input terminals for receiving the low L–M bits and the dither timing bits, and an output terminal for outputting a dither data bit, and an adder having input terminals for receiving the dither data bit and the high M bits, and output terminals outputting for M output data bits.

In a second aspect of the present invention there is provided a dither circuit for reproducing color video data including a bit divider having input terminals for inputting L bits corresponding to input color data and for inputting a clock signal, and output terminals for outputting high L-2 bits of the input color data and two low bits of the input color data, respectively, a multifunction timing generator having input terminals for receiving the clock signal, a horizontal sync signal and a vertical sync signal, and having output terminals for outputting a first dither bit, a second dither bit, a frame timing bit and a dither position bit, a multifunction controller having input terminals for receiving the two low bits of the input color data, the second dither bit, the first dither bit, the frame timing bit and a dither position bit and output terminals for outputting a dither data bit and a multi-data bit, a function selector having input terminals for receiving the dither data bit, the multi-data bit, a selection bit, and a bypass bit, and an output terminal for outputting an adding data bit, and an adder having input terminals for receiving the high L-2 bits of the input color data and the adding data bit, and output terminals for outputting output color data.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention, and are incorporated in and constitute a part of this specification, illustrate embodiments of the invention that together with the description serve to explain the principles of the invention.

Figure 9:
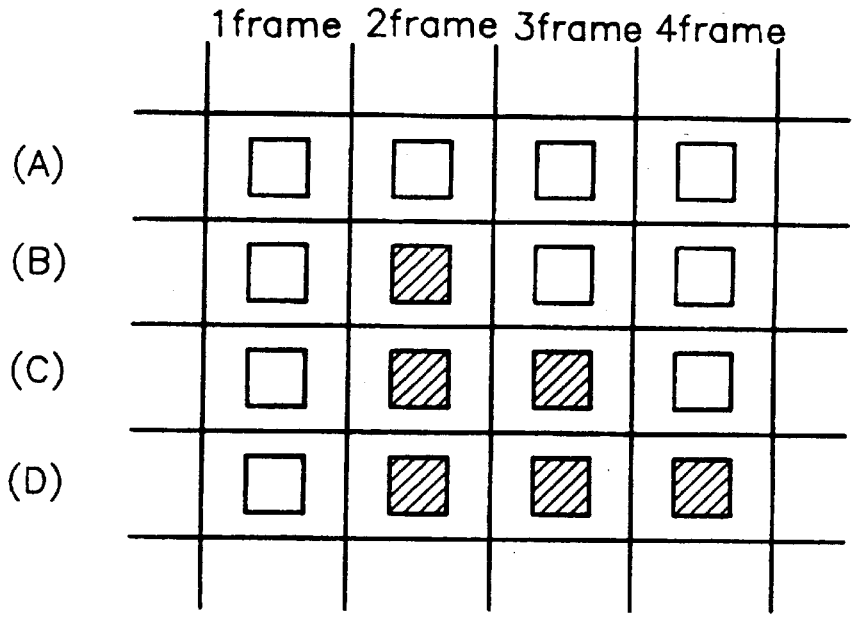
Figure 10:
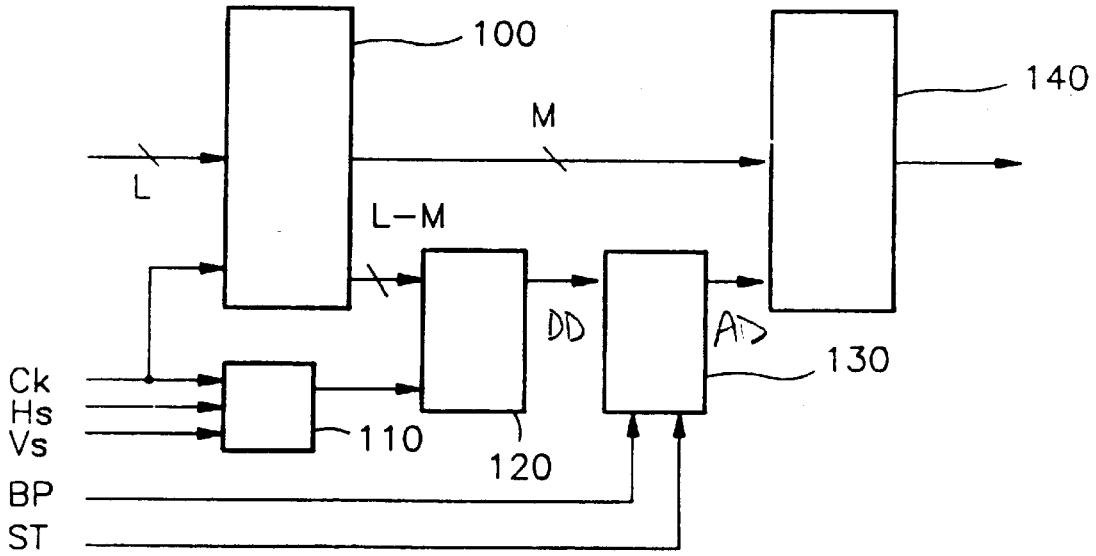
Figure 11:
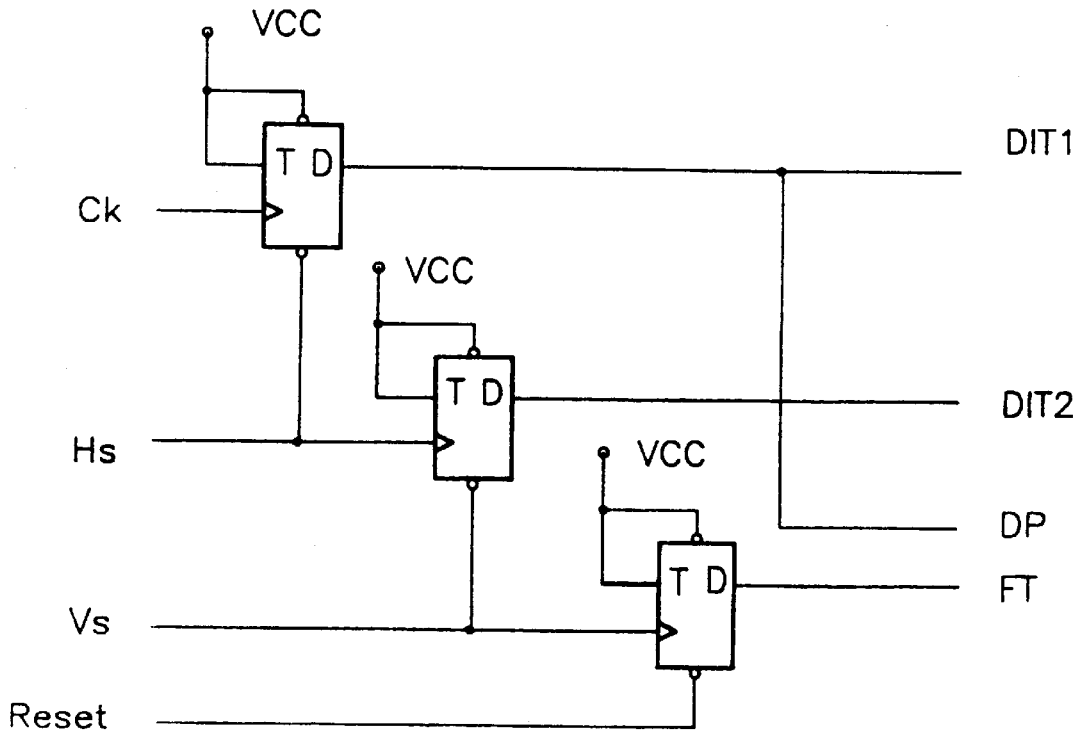
Figure 12:
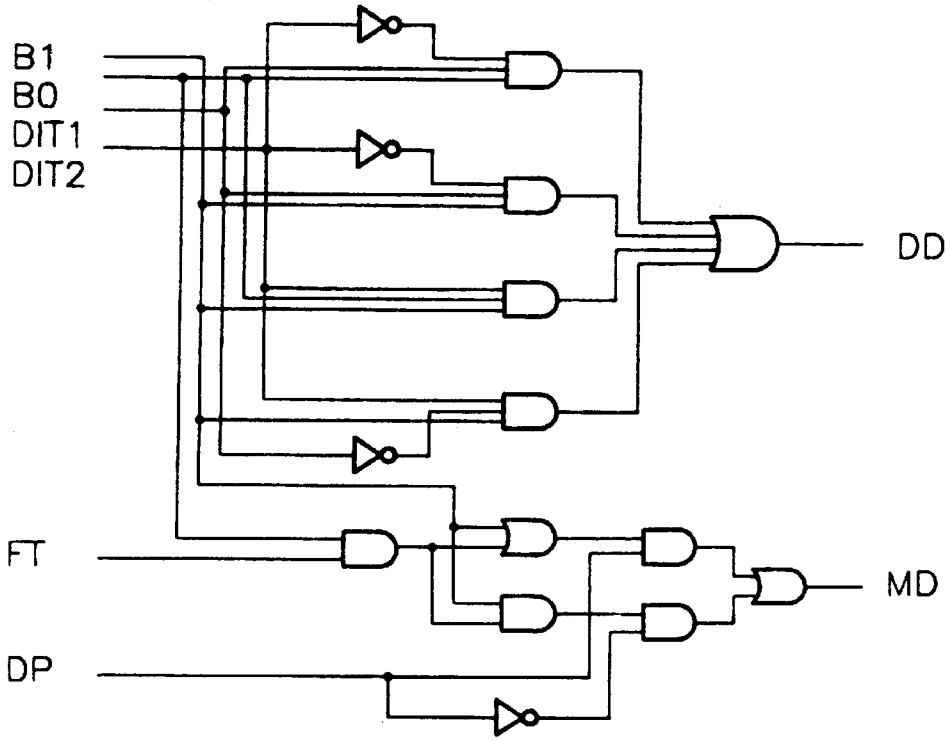
Figure 13:
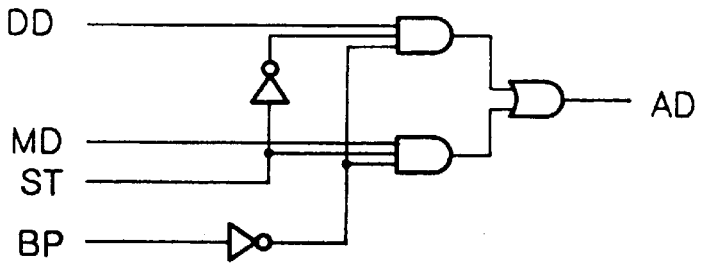
Figure 14:
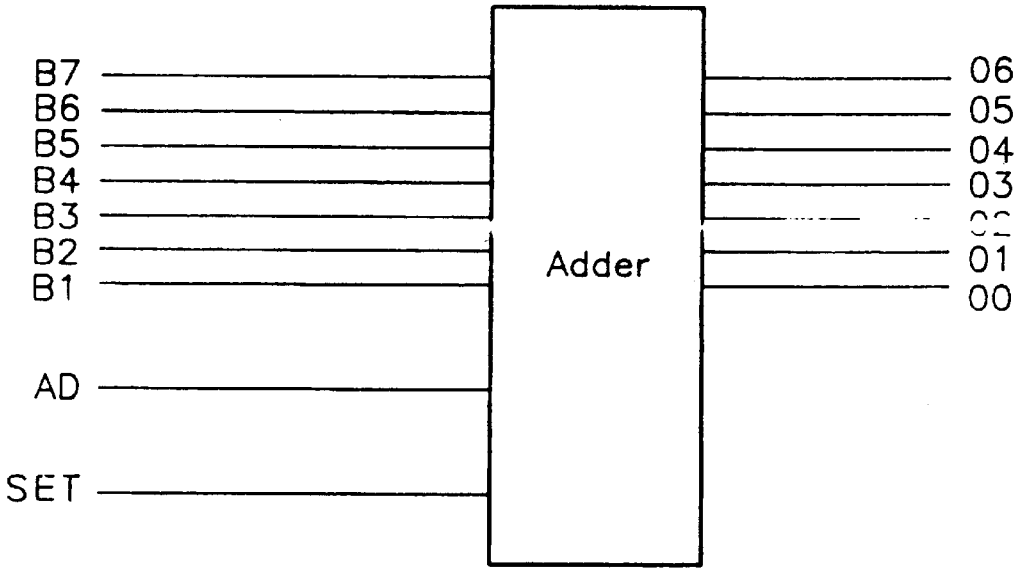

FIGS. 8(A)–8(D) show dithered color patterns of a pixel and its 4 elements having 6-bit color data of the first preferred embodiment of the present invention;

FIG. 9 shows alternated dither color pattern shifting by frame of a second preferred embodiment of the present invention;

FIG. 10 shows a structure of a dither timing generator of the second preferred embodiment of the present invention;

FIG. 11 shows a structure of a multifunction timing generator of the second preferred embodiment;

FIG. 12 shows a structure of a multifunction controller of the second preferred embodiment;

FIG. 13 shows a structure of a function selector of the second preferred embodiment; and FIG. 14 shows a structure of an adder of the second preferred embodiment.

DETAILED DESCRIPTION OF THE PREFERRED EMBODIMENTS

Reference will now be made in detail to the preferred embodiments of the present invention, examples of which are illustrated in the accompanying drawings.

Figure 1:
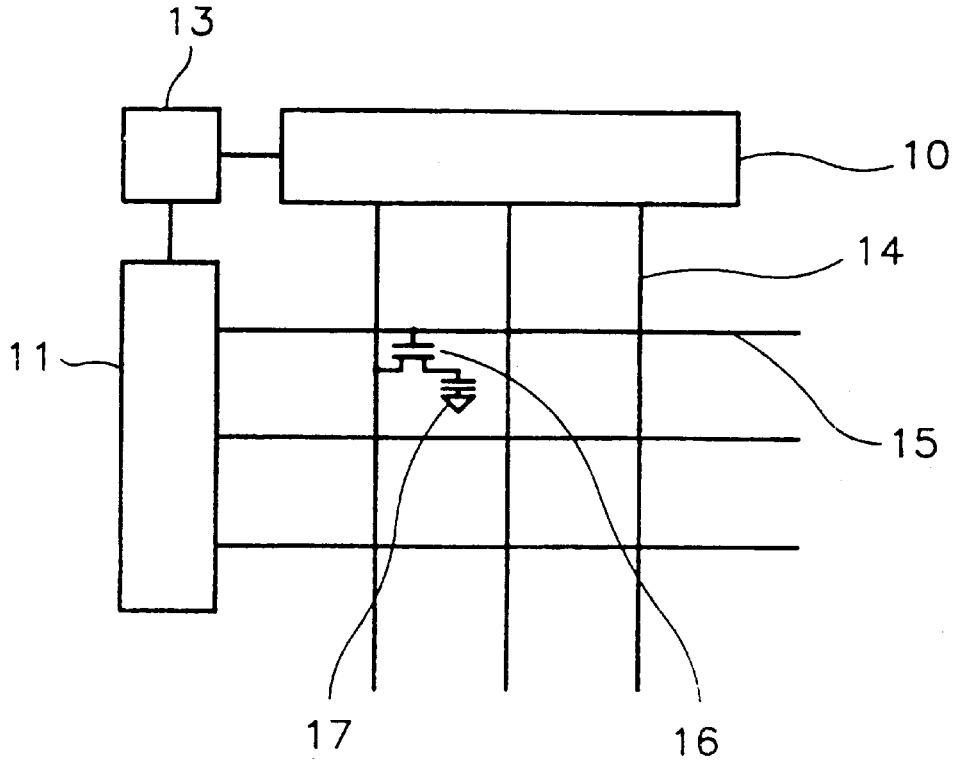
Fig. 1 Conventional Art
FIG. 1 shows a thin film transistor array and a driver IC of a conventional LCD.
Figure 2:
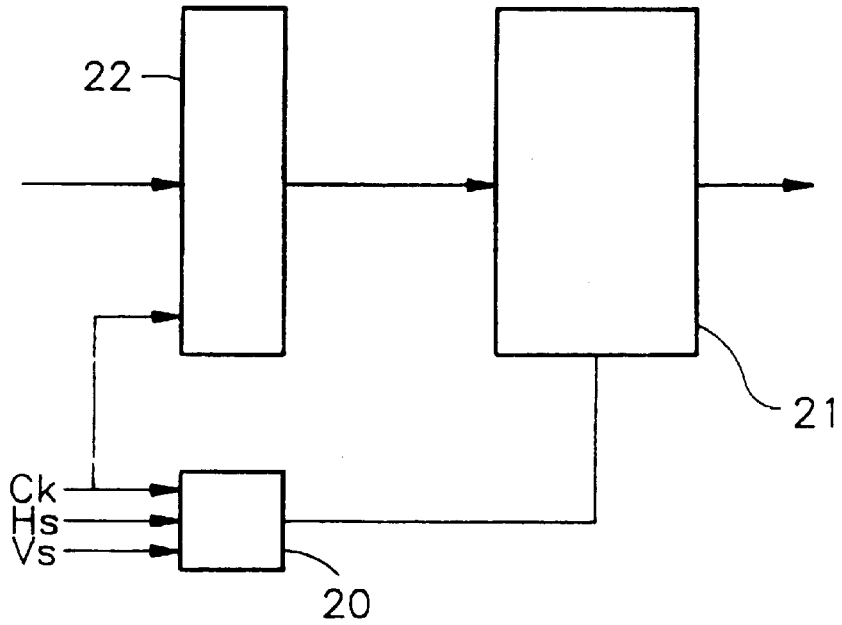
Fig. 2 Conventional Art
FIG. 2 shows a part of the structure of a conventional dither controller IC of a color LCD.
Figure 3:
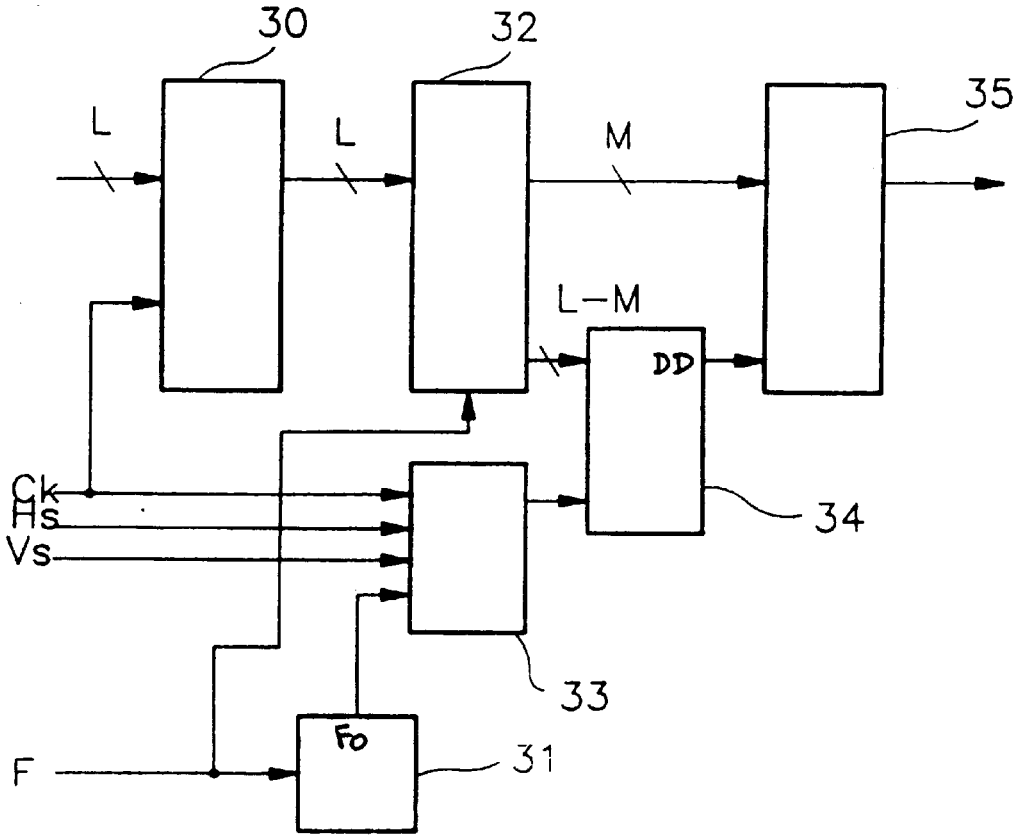
FIG. 3 shows a structure of a dither controller for an LCD of the present invention.

As shown FIG. 3, the present invention has a dither control circuit including a latch 30 having input terminals for L-bit input color information and for a clock signal Ck, and output terminals for L-bit output color data synced with the clock signal Ck; a bit divider 32 having input terminals for the L-bit output color data outputted from the latch 30 and for a low bit number signal F, and output terminals for high M bits and low L–M bits that are determined by the low bit number signal F; a function selector 31 having an input terminal for the low bit number signal F and an output terminal Fo for a dither method signal; a frame rate and dither timing generator 33 outputting a frame rate and dither timing bits having (L–M) bits after inputting a horizontal sync signal $H_s$, a vertical sync signal $V_s$, and a clock signal Ck; a frame rate dither data controller 34 outputting a dither data DD bit by a dither processing with the low (L–M) bits and the dither timing bits; and an adder 35 generating M-bit output color data by adding the high M bits and the dither data DD bit.

A dither processing method of the present invention is further discussed in detail below. The L-bit input color information of one pixel is input to the latch 30. The L bits are divided into high M bits and low L–M bits. On the other hand, in the dither timing generator 33, the dither timing bits are generated using the horizontal sync signal $H_s$, the vertical sync signal $V_s$, and the clock signal Ck. When the position of the color information is determined by the horizontal and the vertical sync signals $H_s$ and $V_s$, the dither data controller 34 generates a dither data DD bit using the dither timing bits and the low L–M bits. The dither data DD bit is added to the high M bits, and complemented output color information is thus generated. The present invention reproduces color information by converting the original color information having L bits to a pseudo color information having M bits, where M is less than L.

Figure 4:
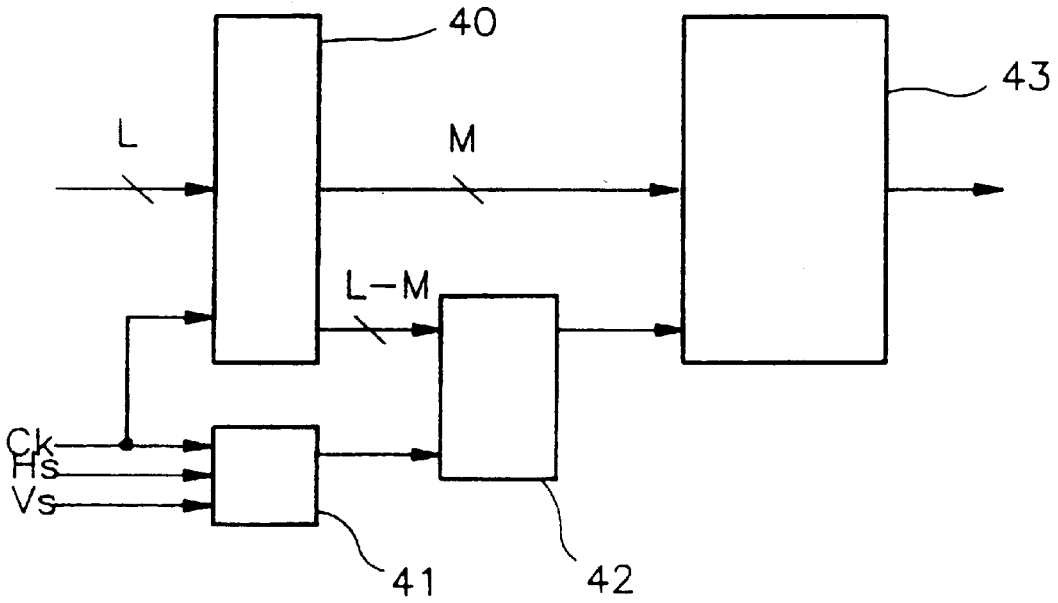
FIG. 4 is a first example of a structure of a first preferred embodiment.

Referring to FIG. 4, a first preferred embodiment of the present invention will now be described.

In the first preferred embodiment, 8-bit input color information is reproduced using 6-bit pseudo color information. The dither method is selected from one of two methods depending on a type of image being displayed.

Figure 5:
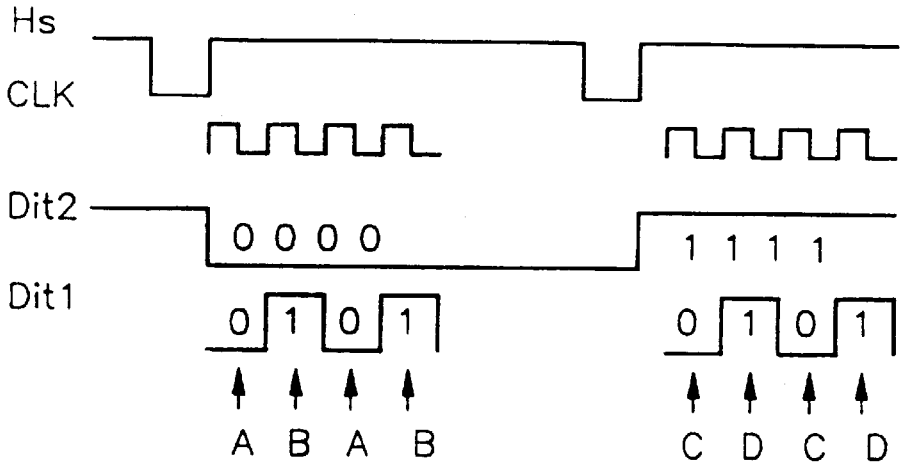
FIG. 5 shows waveforms of dither timing bits Dit1 and Dit2 of the first preferred embodiment.
Figure 6:
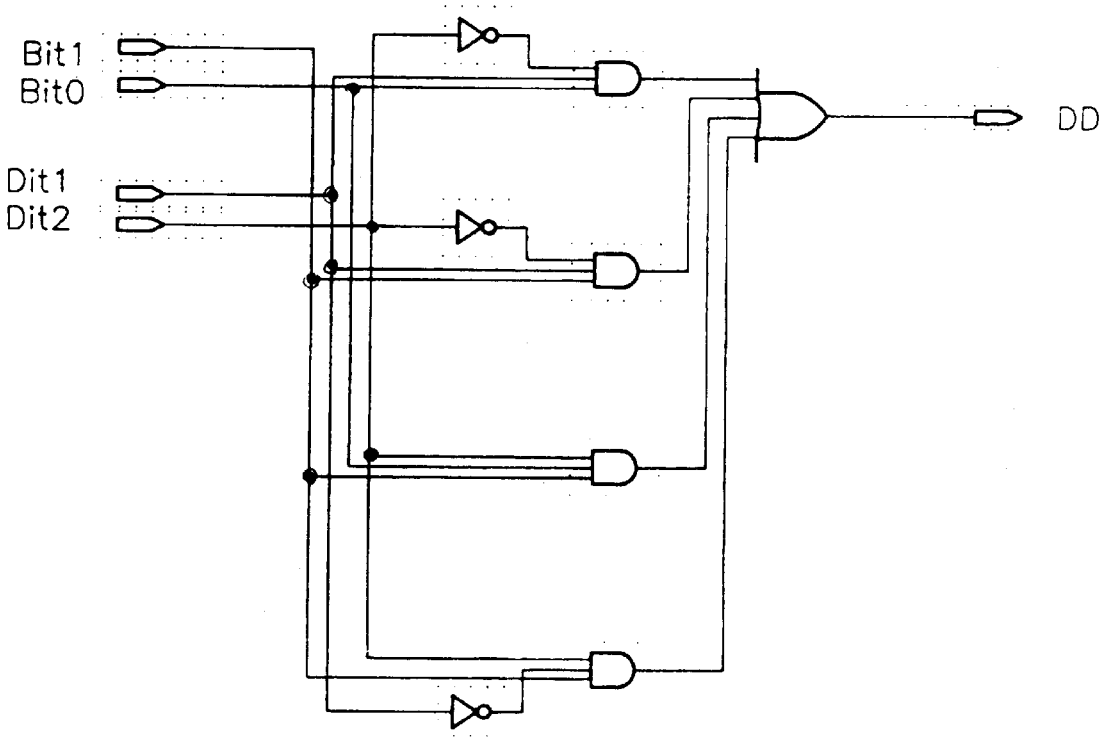
FIG. 6 illustrates a logic circuit generating a dither data DD bit in the first preferred embodiment.

At the dither timing generator 41, dither timing bits Dit1 and Dit2, representing a position of the color data, are generated using the horizontal sync signal $H_s$ and the clock signal Ck. For example, a circuit shown in FIG. 6 can generate the Dit1 and Dit2 signals. Thus, the waveforms of the Dit1 and Dit2 signals are as shown in FIG. 5. The Dit1 signal has double the period of the clock signal Ck, and the Dit2 signal has double the period of the horizontal sync signal $H_s$, as shown in FIG. 5. If a value of the high signal is taken as 1 and a value of a low signal is taken as 0, then 4 dithered groups are selected according to a combination of the Dit1 and the Dit2 signals, as shown in Table 1 below.

TABLE 1

The position of the dithered data

| | Dit1 | Dit2 |
|---|---|---|
| A group | 0 | 0 |
| B group | 0 | 1 |
| C group | 1 | 0 |
| D group | 1 | 1 |

When the values of the Dit1 and Dit2 signals are both lows (0's), the A group is selected. When the Dit1 signal is low and the Dit2 signal is high, the B group is selected. When the Dit1 signal is high and the Dit2 signal is low, the C group is selected. Otherwise, the D group is selected.

Figure 7:
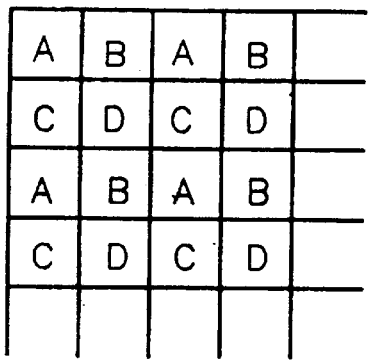
FIG. 7 illustrates a method for grouping pixels of an LCD of the first preferred embodiment.

The 8-bit input color information is divided into high 6 bits (bit 2, bit 3, bit 4, bit 5, bit 6 and bit 7) and two low bits (bit1 and bit0, or least significant two bits) in the latch 40. The two low bits (bit1 and bit0), and the dither timing bits Dit1 and Dit2, are inputted into the dither data controller 42. The dither data controller 42 generates a dither data DD bit, which is 1 or 0. The dither data controller 42, for example, can be based on a logic diagram shown in FIG. 7, and the logic equation is:

DD=Dit2'*Dit1*bit0+Dit2'*Dit1*bit1+Dit2*bit1*bit0+dit2*Dit1'*bit1, where Dit2' is inverted Dit2 bit and Dit1' is inverted Dit1 bit.

Thus, when a dither group is selected using the horizontal sync signal $H_s$ and the clock signal Ck, the dither data for the group is generated in the dither data controller 42 using the two low bits, bit1 and bit0, of the color information, and the dither timing bits Dit1 and Dit2. The dither data is added to the high 6 bits in the adder 43. The output color data having 6 bits is generated and sent to the signal driving IC. Here, the dither data is generated 4 times for the same 8-bit input color data, so the 4 6-bit output color data are sequentially represented in order to reproduce true color.

The 6-bit output color data reproduces the color level with 64 scale colors. In comparison, 8-bit input color information includes 256 scale colors. Therefore, the $128^{th}$ scale in an 8-bit scale can be reproduced with the $32^{nd}$ scale in the 6-bit scale. The $33^{rd}$ scale in the 6-bit scale comes from the $132^{nd}$ scale in the 8-bit scale. Thus, difference of one on the 6-bit scale is a difference of 4 on the 8-bit scale, so there are 3 additional differences in the 8-bit scale. In order to reproduce these 3 additional differences in the 6-bit scale, 4 elements are combined to represent one color. Thus, the present invention reproduces true color using a 6-bit scale. Table 2 shows the relationship of the dither pattern and the dithered data.

TABLE 2

Relationship between the dither pattern and dither data

| | ¼ Dither | ⅔ Dither | ¾ Dither |
|---|---|---|---|
| A group | 0 | 0 | 0 |
| B group | 1 | 1 | 1 |
| C group | 0 | 1 | 1 |
| D group | 0 | 0 | 1 |

In Table 2, a "0" means that the element reproduces the color scale with the high 6 bits of the 8 bits of the input color bits. A "1" means that the group reproduces the color scale with one level higher scale color from the high 6 bits of the 8 input color bits. For ¼ dither, one group among A, B, C and D has a one level higher color scale and the others have the original color scale. For ⅔ dither, two groups among A, B, C and D have a one higher level scale, the others having the original color scale. For ¾ dither, three groups have a one level higher scale, and one other has the original scale.

The relationship of the two low bits, bit1 and bit0, the dither timing bits Dit1 and Dit2, and the dither data DD is shown in Table 3.

TABLE 3

The dither data DD bit logic table

| Dit2 | Dit1 | bit1 | bit0 | DD | Group |
|---|---|---|---|---|---|
| 0 | 0 | 0 | 0 | 0 | A |
| 0 | 0 | 0 | 1 | 0 | A |
| 0 | 0 | 1 | 0 | 0 | A |
| 0 | 0 | 1 | 1 | 0 | A |
| 0 | 1 | 0 | 0 | 0 | B |
| 0 | 1 | 0 | 1 | 1 | B |
| 0 | 1 | 1 | 0 | 1 | B |
| 0 | 1 | 1 | 1 | 1 | B |
| 1 | 0 | 0 | 0 | 0 | C |
| 1 | 0 | 0 | 1 | 0 | C |
| 1 | 0 | 1 | 0 | 1 | C |
| 1 | 0 | 1 | 1 | 1 | C |
| 1 | 1 | 0 | 0 | 0 | D |
| 1 | 1 | 0 | 1 | 0 | D |
| 1 | 1 | 1 | 0 | 0 | D |
| 1 | 1 | 1 | 1 | 1 | D |

Figure 8A:
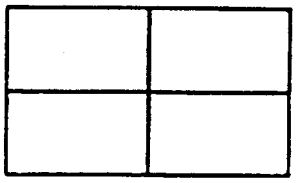

The first embodiment will now be explained in greater detail with reference to Table 3. For example, assume that the 8-bit input color data of one pixel is binary 10110100. The two low bits, bit0 and bit1 are both 0's. In this case, when the Dit1 signal and Dit2 signal are 0's, the dither data DD bit is 0 and the A group is selected. The high 6 bits (101101) are applied to the A group. When the Dit1 signal is 1 and the Dit2 signal is 0, the dither data DD bit is 0, the B group is selected, and the high 6 bits, i.e. 101101, are applied to the B group. When the Dit1 signal is 0 and Dit2 signal is 1, the dither data DD bit is 0 and the C group is selected. The high 6 bits (101101) are therefore applied to the C group. When the Dit1 and Dit2 signals are 1's, the dither data DD bit is 0 and the D group is selected. The high 6 bits (101101) are applied to the D group. Thus, if the two low bits bit1 and bit0 are 0's, then all the elements of the pixel have the same 6-bit output color data, which is the same value of the high 6 bits of the 8-bit input color data. FIG. 8(A) shows the 6-bit output color data of the pixel having the 4 elements, when the low two bits bit1 and bit0 of the 8-bit input color data are 0's.

Figure 8B:
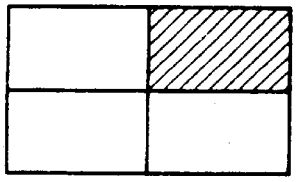

Next, assume that the 8-bit input color data is binary 10110101. The high 6 bits are 101101 and the low two bits are 01. When the Dit1 and Dit1 signals are 0's, the dither data DD bit is 0 and the A group is selected. Thus, the high 6 bits (101101) are applied to the A group. When the Dit1 signal is 1 and the Dit2 signal is 0, the dither data DD bit is 1 and the B group is selected. Thus, 1 is added to the high 6 bits to produce 101110, which is applied to the B group. When the Dit1 signal is 0 and the Dit2 signal is 1, the dither data DD bit is 0, the C group is selected and the high 6 bits (101101) are applied to the C group. When the Dit1 signal and the Dit2 signal are both 1's, the dither data DD bit is 0, the D group is selected, and the high 6 bits (101101) are applied to the D group. FIG. 8(B) shows the output data of the pixel having the 4 elements, when the two low bits bit1 and bit0 of the 8-bit input color data are 0's.

Figure 8C:
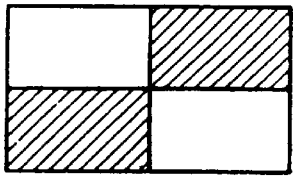

Next, assume that the 8-bit input color data is binary 10110110. The high 6 bits are 101101, and the two low bits are 10. When the Dit1 and the Dit2 signals are 0's, the dither data DD bit is 0 and the A group is selected. Thus, the high 6 bits (101101) are applied to the A group. When the Dit1 signal is 1 and the Dit2 signal is 0, the dither data DD bit is 1 and the B group is selected. Thus, 1 is added to the high 6 bits to produce 101110, which is applied to the B group. When the Dit1 signal is 0 and the Dit2 signal is 1, the dither data DD bit is 1 and the C group is selected. Thus, the same bits that were applied to the B group are applied to the C group. When the Dit1 and the Dit2 are 1's, the dither data DD bit is 0 and the D group is selected. Thus, the high 6 bits (101101) are applied to the D group. FIG. 8(C) shows the output data of the pixel having the 4 elements, when the bit0 bit of the 8-bit input color data is 0 and the bit1 bit of the 8-bit input color data is 1.

Figure 8D:
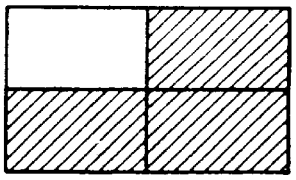

Finally, assume that the input color data is binary 10110111. The high 6 bits are 101101 and the two low bits bitl and bit0 are 11. When the Dit1 and the Dit2 signals are 0's, the dither data dither data DD bit is 0, the A group is selected and the high 6 bits (101101) are applied to the A group. When the Dit1 signal is 1 and the Dit2 signal is 0, the dither data DD bit is 1, and the B group is selected. Thus, 1 is added to the high 6 bits to produce binary 101110, which is applied to the B group. When the Dit1 signal is 0 and the Dit2 signal is 1, the dither data DD bit is 1, the C group is selected, and one bit is added to produce binary 101110, which is applied to the C group. When the Dit1 and the Dit2 signals are 1's, the dither data DD bit is 1, the D group is selected, and one bit is added to produce binary 101110, which is applied to the D group. FIG. 8(D) shows the output data of the pixel having the 4 elements, when the two low bits, bit1 and bit0 , of the 8-bit input color data are 1's.

Finally, how to represent the 4 dithered data groups for one unit of image data will be discussed. Two methods of representation exits. One is a pixel dividing method and another is a frame dividing method. In the pixel dividing method, the pixels on the LCD screen are divided into 2×2 matrixes, and the matrix elements correspond to the 4 dither groups, A, B, C and D, as shown FIGS. 8(A)–8(D). The 4 dithered color data are represented by the 4 pixel elements. Thus, a pixel having 4 pixel elements reproduces true color using 6 bits. This method can represent true color, but the resolution is reduced to about ¼ of the original. However, if the image data does not require high resolution, such as a TV image, this does not present a problem.

In the frame dividing method, a frame for one color data is divided into 4 sub-frames, A, B, C and D, as shown FIG. 9, and the dithered color data are sequentially represented 4 times at the pixel. This method can reproduce true color using 6 bits, but the number of frames increases by a factor of four. Thus, flicker increases. However, if the image data is stationary, like a computer still image, this does not present a problem.

The present invention further includes a circuit for selecting the dithering method. The circuit includes a function selector 31 having an input terminal for a reference signal (the low bit number signal F) for selecting the dither method and an output terminal for the selection signal Fo for the dither method. A circuit for selecting the number of high bits is shown in FIG. 3.

A second preferred embodiment will be described with reference to FIGS. 10–12. The second preferred embodiment is another example of a dither method and selection of the dither method depending on a type of image being displayed.

The second preferred embodiment includes a latch 100 having input terminals for 8-bit input color data and for a clock signal Ck, and output terminals for high 6 bits (M bits) and two low bits (L–M bits). The latch 100 may include a bit divider dividing the 8-bit input color data into the high M bits and low L–M bits. The latch 100 also includes a multi-function timing generator 110 having input terminals for the clock signal Ck, a horizontal sync signal $H_s$ and vertical sync signal $V_s$, and output terminals for a first dither timing bit Dit1, a second dither timing bit Dit2, a dither portion bit DP, and a frame rate timing bit FT (shown in FIG. 11). A multi-function controller 120 having input terminals for the two low bits (L–M)(i.e. bit1 and bit0), the Dit1 and Dit2 bits, DP and FT bits, and output terminals for a dither data DD bit and a multi-data MD bit. A function selector 130 includes input terminals for the dither data DD bit and the multi-data MD bit, a selection ST bit and a bypass bit BP, and an output terminal for an adder AD bit. An adder 140 generate the 6-bit output color data by adding the adder AD bit and the high 6 bits (M bits). Example circuits for elements of the second preferred embodiment is explained below in detail.

FIG. 11 shows an example of a structure of the multi-function generator 110. The Dit1 signal has twice the period of the clock signal Ck. The Dit2 signal has twice the period of the horizontal sync signal $H_s$. The FT signal has twice the period of the vertical sync signal $V_s$. The DP signal has the same shape as the Dit1 signal.

The multi-function controller (MFC) 120 can include, as shown FIG. 12, a dither data DD bit and a multi-data MD bit circuit. The dither data DD bit circuit includes a first AND gate generating a first value using the low 2 bits (bit1 and bit0), the Dit1 bit and an inverted Dit2 bit; a second AND gate generating a second value using the bit1 bit, the Dit1 bit and an inverted Dit2 bit; a third AND gate generating a third value using the two low bits (bit1 and bit0 ) and the Dit2 bit; a fourth AND gate generating a fourth value using the bit1 bit, an inverted Dit1 bit and the Dit2 bit; and a first OR gate generating the dither data DD bit using the first, second, third and fourth values. Furthermore, the multi-data MD bit circuit of the MFC 120 also includes a fifth AND gate generating a fifth value using the bit0 bit and the FT bit; a second OR gate generating the sixth value using the bit1 bit and the fifth value; a sixth AND gate generating a seventh value using the fifth value and the bit1 bit; a seventh AND gate generating an eighth value using the DP bit and the seventh value; an eighth AND gate generating a ninth value using an inverted DP bit and the seventh value; a third OR gate generating the MD bit using the eighth and the ninth value. The FT bit is used for controlling the frame rate and the DP bit is used for determining a pixel position.

The function selector (FS) 130 can include, as shown in FIG. 13, a ninth AND gate generating a tenth value using the dither data DD bit, the selection ST bit and the bypass BP bit; a tenth AND gate generating an eleventh value using the tenth value, the selection bit and the bypass bit BP; a fourth OR gate generating the AD bit using the tenth and the eleventh value.

The adder 140, as shown in FIG. 14, generates the 6-bit output color data by adding the AD bit to the high 6 bits. Here, if the high 6 bits are all 1's, then the adding operation is bypassed by the SET signal.

The work flow of the dither controller according to the second preferred embodiment is as follows. The 8-bit input color data is applied to the latch 100 divider. The 8-bit input color data is divided into the high 6 bits and the two low bits bit1 and bit0. The two low bits bit1 and bit0 are applied to the multi-function controller 120. At the same time, the Dit1 and Dit2 signals are generated at the multi-function timing generator 110 by using the horizontal sync signal $H_s$, the vertical sync signal $V_s$, and the clock signal Ck. The Dit1 and the Dit2 signals are also applied to the multi-function controller 120. The multi-function controller 120 generates the dither data DD bit using the method described above, i.e. by using the two low bits (bit1 and bit0) and the Dit1 and Dit2 bits. The dither data DD bit is applied to the function selector 130. The function selector 130 determines the dithering method using the function selection signal and applies the dither data DD bit to the adder 140. Thus, the dithered 6-bit output color data generated by adding the high 6 bits and the dither data DD bit are applied to a data line driver of the LCD.

In general, it is very difficult to increase the number of colors of one pixel in an LCD. In order to increase the number of colors in the LCD, the number of bits applied to the data line driver must be increased. However, the driver IC used for controlling more bits is very expensive.

The present invention presents the method for reducing the price for reproducing true color using fewer color control bits. For example, 8-bit input color data can be reproduced using 7 or fewer bits. Also, 7 bit input color data can be reproduced using 6 or fewer bits.

Furthermore, the invention presents a selection method for dither depending on video quality desired. Thus, the present invention discloses a method of representing video data including true color and enhanced quality.

While the invention has been described in detail and with reference to specific embodiments thereof, it will be apparent to one skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A dither circuit for reproducing a plurality of colors comprising:

a latch having input terminals for receiving L input data bits and a clock signal, and having output terminals for outputting L output bits;

a bit divider having input terminals for receiving the L output bits and a function selection signal, and having output terminals for outputting high M bits and low L–M bits;

a function selector having an input terminal for receiving a low bit number signal and an output terminal for outputting a dither method signal;

a frame rate and dither timing generator having a first input terminal for receiving the clock signal, a second input terminal for receiving a horizontal sync signal, a third input terminal for receiving a vertical sync signal and a fourth input terminal for receiving the dither method signal, and having output terminals for outputting dither timing bits;

a frame rate dither controller having input terminals for receiving the low L–M bits and the dither timing bits, and an output terminal for outputting a dither data bit; and an adder having input terminals for receiving the dither data bit and the high M bits, and output terminals for outputting M output data bits.

2. The dither circuit of claim 1, wherein the input terminals for the L input data bits of the latch receive L color data bits corresponding to a color video signal.

3. The dither circuit of claim 1, wherein L is greater than M.

4. The dither circuit of claim 1, wherein the frame rate and dither timing generator further includes:

a first circuit for processing the dither method signal wherein the dither method signal has twice a period of the horizontal sync signal; and a second circuit for processing the dither position bit.

5. A dither circuit for reproducing color video data comprising:

a bit divider having input terminals for inputting L bits corresponding to input color data and for inputting a clock signal, and output terminals for outputting high L-2 bits of the input color data and two low bits of the input color data, respectively;

a multifunction timing generator having input terminals for receiving the clock signal, a horizontal sync signal and a vertical sync signal, and having output terminals for outputting a first dither bit, a second dither bit, a frame timing bit and a dither position bit;

a multifunction controller having input terminals for receiving the two low bits of the input color data, the second dither bit, the first dither bit, the frame timing bit and a dither position bit and output terminals for outputting a dither data bit and a multi-data bit;

a function selector having input terminals for receiving the dither data bit, the multi-data bit, a selection bit, and a bypass bit, and an output terminal for outputting an adding data bit; and an adder having input terminals for receiving the high L-2 bits of the input color data and the adding data bit, and output terminals for outputting output color data.

6. The dither circuit of claim 5, wherein the adder includes an adding circuit.

7. The dither circuit of claim 5, wherein the multifunction controller generates the dither data bit satisfying a logical equation:

$$(\text{bit}0*\text{Dit}1*\text{Dit}2')+(\text{bit}1*\text{Dit}1*\text{Dit}2')+(\text{bit}0*\text{bit}1*\text{Dit}2)+(\text{bit}0*\text{bit}1*\text{Dit}1'),$$

wherein bit0 is a least significant bit of the input color data, bit1 is a second least significant bit of the input color data, Dit1 is a first dither bit, Dit2 is a second dither bit, Dit1* is an inverted first dither bit, and 2nd Dit2' is an inverted second dither bit.

8. The dither circuit of claim 5, wherein the multifunction controller generates the multi-data bit satisfying a logical equation:

$$\{(FT*bit\mathbf{0}+bit\mathbf{1})*DP\}+[\{(FT*bit\mathbf{0})*bit\mathbf{1}\}*DP'],$$

wherein FT is a frame rate timing bit, bit0 is a least significant bit of the input color data, bit1 is a second least significant bit of the input color data, DP is the dither position bit, and DP' is an inverted dither position bit.

9. The dither circuit claim 5, wherein the function selector generates the adding data bit satisfying the logical equation $$(DD*ST'*BP')+(MD*ST*BP'),$$

wherein DD is the dither data bit, ST is the selection bit, ST' is an inverted selection bit, MD is the multi-data bit, and BP' is an inverted bypass bit.

* * * * *